US009330641B2

(12) United States Patent
Massimo

(10) Patent No.: US 9,330,641 B2
(45) Date of Patent: May 3, 2016

(54) PERCUSSIONISTS' MALLET TOWEL

(71) Applicant: Brian Massimo, Zion, IL (US)

(72) Inventor: Brian Massimo, Zion, IL (US)

( * ) Notice: Subject to any disclaimer, the term of this patent is extended or adjusted under 35 U.S.C. 154(b) by 48 days.

(21) Appl. No.: 14/257,664

(22) Filed: Apr. 21, 2014

(65) Prior Publication Data

US 2015/0302837 A1 Oct. 22, 2015

(51) Int. Cl.

| | |
|---|---|
| ***G10D 13/00*** | (2006.01) |
| *A45C 11/26* | (2006.01) |
| *B65D 85/20* | (2006.01) |

(52) U.S. Cl.

CPC ..... *G10D 13/003* (2013.01); *A45C 11/26* (2013.01); *B65D 85/20* (2013.01); *Y10S 224/91* (2013.01)

(58) Field of Classification Search

CPC .. G10D 13/00; G10D 13/003; Y10S 312/902; Y10S 224/91; A45C 3/00; A45C 11/26; A45C 11/34; A61B 19/02; B65D 85/20; B65D 85/22; B65D 85/24; B65D 85/26; B65D 85/28

See application file for complete search history.

(56) References Cited

U.S. PATENT DOCUMENTS

| | | | | |
|---|---|---|---|---|
| 3,749,233 | A * | 7/1973 | McCormick, Jr. | A45C 11/26 206/373 |
| 3,967,668 | A * | 7/1976 | Franco | A45C 3/00 383/4 |
| 4,149,635 | A * | 4/1979 | Stevens | A61B 19/0271 206/370 |
| 4,682,691 | A * | 7/1987 | Spiering | B25H 3/00 206/373 |
| 5,117,724 | A * | 6/1992 | Gardner | G10D 13/003 206/314 |
| 5,515,969 | A * | 5/1996 | Schonenbach | B25H 3/04 206/373 |
| 7,687,699 | B2 | 3/2010 | Briggs et al. | |
| 2006/0272581 | A1 * | 12/2006 | Dunn | A01K 1/0353 119/28.5 |
| 2011/0073123 | A1 * | 3/2011 | Ferrence | A45D 29/20 132/73 |

* cited by examiner

*Primary Examiner* — Andrew Perreault
(74) *Attorney, Agent, or Firm* — Husch Blackwell LLP

(57) ABSTRACT

A percussionist's towel comprises a terry-cloth towel having a deformable band centrally located between the long edges of the towel and preferably including grommets along the shorter edges of the towel. The deformable band may comprise a pocket filled with microbeads, foam, padding, flocculation, or other substances used for pillows. The towel and deformable band are sound-deadening. The deformable band deters percussion mallets or the like from rolling off the towel when the towel is placed on a music stand that has been set into a generally horizontal position to function as a table.

11 Claims, 2 Drawing Sheets

PERCUSSIONISTS' MALLET TOWEL

BACKGROUND OF THE INVENTION

The present invention relates to a percussionist's towel. Percussionists can be called upon to play multiple different instruments during a single evening, including, for example, various forms of drums, kettledrums, timpani, xylophone, marimba, triangle, chimes, gongs, cymbals, and others. With some exceptions such as the conga or maracas, most of these instruments involve striking a surface with a hand-held striking device. Different types of striking devices are used for different instruments. For example, one would not normally use the same striking device on both a snare drum and a timpani, chime, or xylophone. These striking devices are typically called drumsticks, mallets, brushes, and the like. Indeed, a percussionist might use different sizes of mallets during a single performance and may use other striking devices also. Some striking devices have a felt head while others may have a hard plastic striking head. Sometimes wood or metal is used, depending on the sound that the percussionist, conductor, or composer wishes to obtain.

Not only must all of these various striking devices be transported to the performance venue, but they must also be available on demand to the percussionist. Additionally, the percussionist must eliminate extraneous sounds when changing from one striking device to another. That is, he or she must quietly place one (or a pair) of devices down and pick up another.

One prior art approach is seen in U.S. Pat. No. 7,687,699 by Briggs and Veepuisis, assigned to Silclear Limited. That patent teaches a holder for drum sticks, drum brushes, mallets and other percussion implements. The holder comprises a plurality of substantially parallel tubular sleeves, each joined to one or more adjacent sleeve(s), and having an entrance dimensioned to receive just one drum stick. The sleeves are made of an elastomeric material to grip the inserted drum stick. The device can be mounted on a tripod stand.

Another approach is akin to an arrow quiver and provides a generally tubular structure with an open top and closed bottom for holding several drumsticks. Such a holder may be tapered, and it can be mounted to a drum set or other percussion instrument.

Yet another approach provides a customized towel to be placed on a music stand and draped over the front lip or ledge of the music stand so that part of the towel resides on the flat portion of the music stand and part of it drapes over the front of the music stand. The part of the towel hanging over the lip may support three or four side-by-side pockets to hold mallets, drumsticks, or other striking devices of different sizes. The broad, flat part sitting upon the flat portion of the music stand can be used to hold illustratively one or two of a cymbal, tambourine, cowbell, triangle, or other comparatively small percussion instrument.

By far the most widely-used approach by professional percussionists for holding a variety of percussion striking devices is far simpler and involves fashioning a makeshift trap table by placing a towel (usually black or dark) upon a standard, black wrinkle steel, telescoping orchestral music stand. Percussionists have frequently re-purposed such music stands, readily available to the orchestra or band, as a mallet and drumstick table, simply by rotating the head of the music stand so that its major flat surface becomes substantially horizontal and the lip becomes substantially vertical. This provides a generally horizontal surface with a small upstanding lip along one edge, typically the front edge relative to the percussionist. Further, percussionists have commonly placed a towel on top of the music stand flat surface to act as a sound deadening device to muffle or mute the sound that would otherwise be made when placing the mallet onto the generally metallic music stand.

When using this latter approach, a common and dreaded problem is that striking members are usually rounded and thus apt to roll when set upon an inclined surface or when given sufficient impetus. That can occur if the music stand is kicked, hit, or jostled inadvertently. Once the striking devices begin to roll, they often roll off the towel and off the "table" (music stand), crashing on the floor, generating highly noticeable extraneous sound, audience distraction and disapprobation, recording problems, and excessive embarrassment.

The present invention provides an improved percussion towel to place upon a music stand conscripted to that use or on another flat table for holding percussive striking devices.

SUMMARY OF THE INVENTION

According to aspects of the present invention, a towel or other suitable member for deadening sound is provided of a size commensurate with the table or music stand's major flat surface. A deformable member is centrally affixed to the towel or other suitable member. The deformable member is constructed to yield and deform at the location where a percussionist sets down a striking device so that the striking device sinks into the deformable member. Preferably but not necessarily the deformable member is in the shape of a band that extends across the center or central region of the towel or other suitable member.

BRIEF DESCRIPTION OF THE DRAWINGS

In describing a preferred embodiment of the present invention, reference is made to the accompanying drawings wherein.

DESCRIPTION OF PREFERRED EMBODIMENTS

A preferred embodiment of the present invention comprises a generally rectangular towel having a length and a width generally commensurate with the size of the major flat surface of a standard music stand. It further comprises a deformable member or band smaller in size than the towel and oriented generally centrally, having a major dimension along the length of the towel and a minor dimension along the width of the towel. As used here, "length of the towel" is the longer of the two dimensions.

Figure 1:
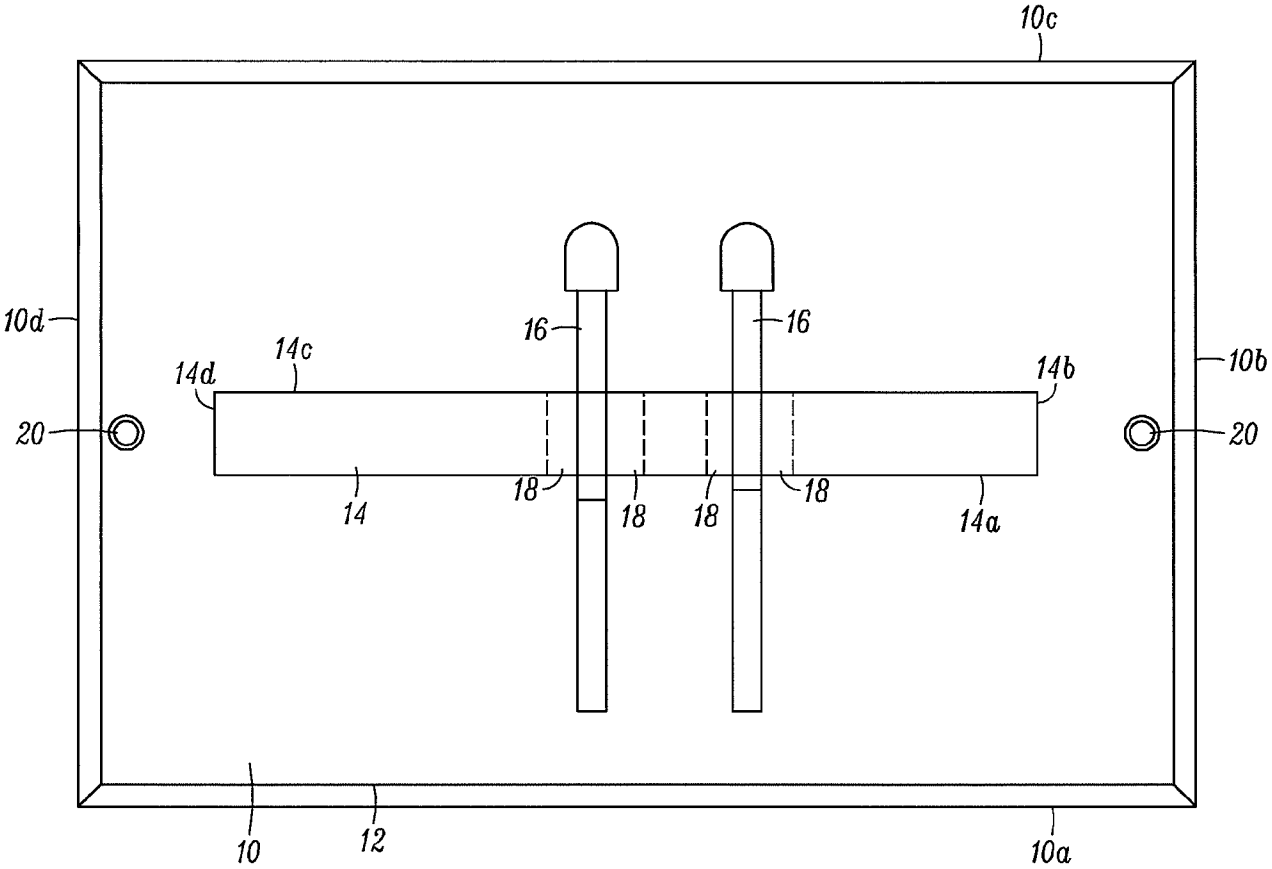
FIG. 1 represents a plan view of a percussion towel according to various aspects of the present invention.

According to the preferred embodiment shown in FIG. 1, a towel 10 is made of a relatively thick terry cloth of the type one can purchase as a "plush" bath towel from major department stores or other vendors. It preferably has a high loft so that its uncompressed thickness may approach one-fourth of one inch. A thinner cloth may be used provided that it is sufficient to deaden and mute the sound of a mallet or other percussion striking device being placed (or dropped) onto the cloth when the cloth is located upon a metal surface. Preferably, the towel is banded with a sewn-on banding 12 of another cloth that is woven and generally smooth to prevent fraying at the edges. A preferred towel length is about 26.5 inches and a preferred width is about 21 inches.

A deformable member 14 is affixed generally centrally in the towel 10, in a middle region thereof. As can be seen, member 14 is generally rectangular in plan view in the preferred embodiment, and illustratively may have a width of 2.3 inches and a length of 17.25 inches. These dimensions are not critical. Illustratively, deformable member 14 may have a height of 0.5-0.75 inches. A preferred deformable member 14 comprises a cloth pocket sewn onto the towel 10 and filled with microbeads. Microbeads, sometimes called microspheres, are well known and are commonly available from craft stores, for example, or directly from manufacturers such as Fairfield Poly-Fil® from Jo-Ann Fabrics. After inserting the microbeads into the pocket, the pocket is then sewn to be completely sealed. Preferably, the microbeads do not fill the pocket to its maximum capacity but instead allow local deformation of member 14 where a mallet 16 is placed onto member 14. (Two mallets 16 are shown in FIG. 1, but it will be understood that the mallets do not form part of the invention and are shown for illustrating the use of the preferred embodiment.) The weight of mallet 16 causes member 14 to yield in regions 18 to the left and right of where the mallet has been placed, so that the mallet sinks or nestles into member 14. Regions 18 are depressions in member 14 formed as the result of placing a mallet 16 onto member 14 and towel 10. The deformable member 14 is preferably soft and mushy in one embodiment so that regions 18 effectively deter mallets 16 from rolling left or right.

Ideally, the positioning of the deformable member is between nine and ten inches from each long edge of the towel 10. That is, the towel 10 may have edges 10*a*, 10*b*, 10*c*, 10*d*, and the deformable member may have edges 14*a*, 14*b*, 14*c*, 14*d*. The preferred distance separating edge 14*a* (which is a lengthwise edge) from 10*a* (also a lengthwise edge) is between 9 and 10 inches. Likewise, a preferred distance between edges 10*c* and 14*c* is between 9 and 10 inches. For the smaller dimensions, the preferred distance from the shorter edge 10*b* of the towel to the shorter edge 14*b* of the deformable pocket is on the order of 4 to 5 inches. Likewise, the preferred distance from short edge 10*d* to short edge 14*d* is similarly 4 to 5 inches.

Preferably, a pair of grommets 20 are affixed to the towel 10 in line with the deformable member 14. Thus, grommets 20 are located generally centrally along the shorter edges of the towel, at the outside margin, as shown in FIG. 1. Nominally, the grommets are 1 inch in diameter at the outer dimension and have an opening of about 0.5 inches. Grommets 20 may be made of metal or can be a synthetic, or even rubber.

Variations can be made with respect to deformable member 14. It does not need to be a pocket filled with microbeads but can instead comprise a different deformable structure. Any substance or material that one would use in a soft bed pillow is generally suitable as a member 14, as the member 14 acts as a pillow for the mallet or other striking device. An example of a substitute would be an easily compressible foam rubber pad that is preferably is covered with cloth. Other soft, deformable structures can be used as member 14. Any type of padding should also be suitable. The substitutes need not be woven but may comprise nonwoven materials or flocculation within a contained volume forming member 14. The deformable member should be sound deadening and should deform noticeably where a mallet or other percussion striking device is rested upon it. It should deform at least enough to pillow the striking device so that the member 14 resists the mallet rolling away from where the percussionist placed it. Thus, the deformable member should deform noticeably when a striking device is placed upon it and should nestle the mallet (or other striking device) in member 14.

Figure 2A:
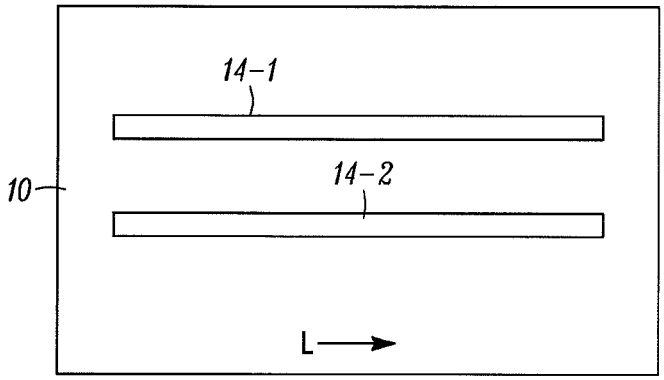
FIGS. 2A, 2B, and 2C are sketches showing alternate placements of the deformable member(s) on the towel.

Member 14 may be fixed relatively permanently to the towel 10 by stitching which is not easily removable. Alternatively, member 14 can be detachably attached to towel 10 by means of a hook and loop arrangement commonly known as Velcro. A suitable fabric for member 14 is polyester, rayon or Spandex Referring to FIG. 2A, it will be appreciated that the preferred embodiment uses a single deformable member 14. However, member 14 need not be limited to just a single, centrally located, member but could comprise a pair of parallel deformable members 14-1, 14-2 generally extending in the lengthwise direction (L; see arrow) of the towel.

Figure 2B:
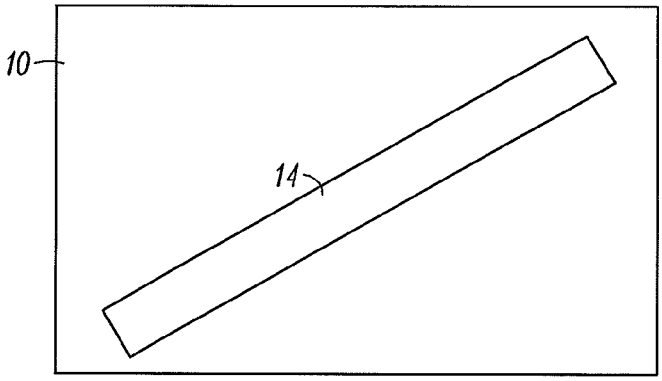

Referring to FIG. 2B, still alternatively, a single deformable member 14 need not be oriented parallel to any edge of towel 10 but instead may be oriented obliquely, at an angle with respect to the towel edges. This would allow placement of different size striking devices, some longer and some shorter, upon towel 10 and deformable member 14.

Figure 2C:
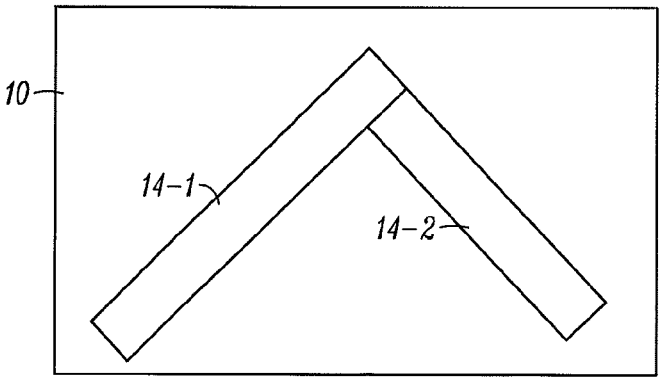

Referring to FIG. 2C, another option is for a pair of deformable members 14 to be arranged generally in a Chevron or zig-zag configuration upon towel 10.

The eyelets or grommets 20 can be used to close the towel by means of any convenient closure or retaining device. This facilitates transporting the various striking devices which may be wrapped within towel 10 and closed.

The specific dimensions of the towel are not critical but the size mentioned herein is for a nominal music stand. The size may be increased or decreased in any dimension to use all or most of the available surface of the music stand without excessively draping the cloth over the edges.

I claim:

1. A percussionist's towel for use during musical performances to reduce the risk of a percussive striking device causing unwanted noise or falling, the towel comprising:

a generally rectangular towel having a length of about 26 inches and a width of about 21 inches;

a generally rectangular deformable member affixed to the towel and having at least a portion in a middle region of the towel, spaced apart from edges of the towel, the deformable member being located generally in a middle region between two opposed edges of the towel, the deformable member having a length of about 17.25 inches, a width of about 2.3 inches, and a thickness between about 0.375 inches and about 0.75 inches, wherein the deformable member is thicker than the towel and is yieldable and locally deformable at a location where a percussive striking device or percussive instrument may be placed upon it, so that such device or instrument would depress the deformable member, whereby the towel may be placed on a music stand that has been adjusted to orient its major flat surface generally horizontally thereby to muffle sound when a user would place a percussive striking device or percussive instrument on the deformable member and the towel and whereby the deformable member diminishes the risk that an item so placed will roll off of the stand.

2. The towel of claim 1 wherein the deformable member comprises padding and the towel comprises terry cloth.

3. The towel of claim 1 wherein the deformable member comprises a cloth pocket filled with microbeads or granules.

4. The towel of claim 1 wherein the deformable member comprises two or more deformable members.

5. The towel of claim 4 wherein two of the deformable members are parallel to each other and parallel to an edge of the towel.

6. The towel of claim 4 wherein two of the deformable members are contiguous at one point and diverge therefrom.

7. The towel of claim 1 further comprising a pair of grommets located adjacent to opposite edges of the towel.

8. The towel of claim 1 further including stitching between the deformable member and the towel.

9. The towel of claim 1 wherein the deformable member is removably attached to the towel.

10. The towel of claim 1 wherein the towel is a terry cloth towel and wherein the deformable member is selected from the group comprising padding, a pocket filled with microbeads, deformable foam, flocculation, or nonwoven material.

11. The towel of claim 1 wherein the deformable member has a thickness in the range of 0.5 inches to 0.75 inches.

* * * * *